US006273693B2

(12) United States Patent
Hida et al.

(10) Patent No.: US 6,273,693 B2
(45) Date of Patent: Aug. 14, 2001

(54) SCREW COMPRESSOR

(75) Inventors: Takeshi Hida; Shigekazu Nozawa; Masayuki Urashin; Noriyuki Yamazaki, all of Shimizu (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/730,576

(22) Filed: Dec. 7, 2000

Related U.S. Application Data

(62) Division of application No. 09/287,560, filed on Apr. 6, 1999.

(30) Foreign Application Priority Data

Apr. 9, 1998 (JP) ..... 10-097022

(51) Int. Cl.[7] ..... F01C 1/02
(52) U.S. Cl. ..... 418/55.6; 418/201.1; 418/DIG. 1
(58) Field of Search ..... 418/55.6, DIG. 1, 418/201.1

(56) References Cited

U.S. PATENT DOCUMENTS

| | | |
|---|---|---|
| 2,455,297 | 11/1948 | Curtis . |
| 3,312,387 | 4/1967 | Cassidy . |
| 3,408,828 | 11/1968 | Soumerai . |
| 3,820,923 | 6/1974 | Zwiefel . |
| 3,820,924 | 6/1974 | Cassidy . |
| 4,913,634 | 4/1990 | Nagata . |
| 5,246,357 | 9/1993 | Sjoholm . |
| 5,494,412 | 2/1996 | Shin . |

FOREIGN PATENT DOCUMENTS

| | | | | |
|---|---|---|---|---|
| 0146098 | | 9/1982 | (JP) . | |
| 0285689 | | 11/1989 | (JP) . | |
| 0060416 | | 2/1991 | (JP) . | |
| 30-026879 | | 2/1991 | (JP) . | |
| 5-010283 | | 1/1993 | (JP) . | |
| 5-133334 | * | 5/1993 | (JP) | 417/228 |
| 6-042476 | * | 2/1994 | (JP) | 418/DIG. 1 |
| 8-144982 | * | 6/1996 | (JP) | 418/DIG. 1 |

OTHER PUBLICATIONS

Patent Abstracts of Japan, vol. 15, No. 155 (M–1104) Apr. 18, 1991.
Patent Abstracts of Japan, vol. 14, No. 60 (M–0931), Feb. 5, 1990.
Patent Abstracts of Japan, vol. 17, No. 282 (M–1420) May 31, 1993.

* cited by examiner

*Primary Examiner*—Thomas Denion
*Assistant Examiner*—Theresa Trieu
(74) *Attorney, Agent, or Firm*—Antonelli, Terry, Stout & Kraus, LLP

(57) ABSTRACT

Oil separation from discharge gas of a screw compressor is performed with a demister provided in a discharge chamber. For solving unevenness in the speed distribution of the gas in the chamber, at least one auxiliary demister for oil separation is disposed at a local position immediately behind or near the downstream side of an outlet of a discharge passage in a discharge casing so as to be perpendicular to the flow direction of the gas at the outlet. In addition, at least one obstacle plate is disposed on the downstream side of the auxiliary demister.

2 Claims, 3 Drawing Sheets

SCREW COMPRESSOR

This application is a divisional application of U.S. Ser. No. 09/287,560, filed Apr. 6, 1999.

BACKGROUND OF THE INVENTION

The present invention relates to a screw compressor, particularly to a screw compressor with a simple construction suitable for efficiently separating oil from discharge gas.

In a conventional screw compressor, as disclosed in Japanese Patent Unexamined Publication No. 10283/1993, a mesh demister is provided in a discharge chamber such that the former includes the whole of a cross section of the latter. There is such a structure that discharge gas discharged from a discharge casing into the chamber is passed through the mesh demister to separate oil contained in the discharged gas.

The efficiency of such a mesh demister separating oil is connected with the speed of gas passing. Either of the speed and flow rate of gas discharged into the discharge chamber has a distribution in a cross section of the chamber. So the gas passes through the mesh demister at uneven speeds and flow rates. More specifically, either of the speed and flow rate near the outlet of a discharge passage of the discharge casing is greater than that of the other parts.

That is, in the whole of the mesh demister, the flow rate in the downstream part of the discharge outlet is great but the speed therein is far from the optimum passing speed for the mesh demister. This causes a problem of remarkably reducing the oil separation efficiency. For solving this problem, some measures were hitherto conventionally taken, e.g., an obstacle plate is provided independently in the chamber or modifying flow passage of discharge gas to change the direction of gas flow and thereby make the flow rate distribution in the chamber even.

However, those measures also have such problems as that the fixing portion of the independent obstacle plate is apt to be damaged, oil scatters again immediately after colliding, and the performance of the compressor deteriorates with an increase in pressure loss due to change of the flow direction.

SUMMARY OF THE INVENTION

The present invention is made in view of the above-mentioned problems, and it is an object of the present invention to provide a screw compressor with a simple construction, high efficiency of separating oil from discharge gas, and a small amount of oil entrained out of the compressor.

A screw compressor as achieves the object of the present invention comprises a casing including at least one pair of male and female rotors engaging with each other, an electric drive motor and a bearing member; a discharge casing provided with a discharge passage for gas and attached to the casing; a discharge chamber provided therein with a main demister for oil separation, a wall of said discharge chamber being joined with the casing such that the discharge chamber contains the discharge casing; and at least one auxiliary demister disposed at a local position immediately behind or near the downstream side of an outlet of the discharge passage so as to be perpendicular to the flow direction of gas at the outlet.

At least one obstacle plate may be disposed on the downstream side of the auxiliary demister.

According to another aspect of the present invention, a screw compressor comprises a discharge casing provided with a discharge passage for gas compressed by male and female rotors engaging with each other; a discharge chamber containing the discharge casing; a main demister disposed in the discharge chamber; and an auxiliary demister disposed on the upstream side of the main demister in the discharge chamber so as to be opposite to an outlet opening of the discharge passage. A member may be disposed on the upstream side of the main demister in order to uniformize each distribution of the speed and flow rate of discharge gas from the discharge passage in the discharge chamber. An obstacle plate may be disposed between the auxiliary and main demisters.

According to another aspect of the present invention, a screw compressor comprises a discharge casing provided with a discharge passage for gas compressed by male and female rotors engaging with each other; a discharge chamber containing the discharge casing; a main demister disposed in the discharge chamber; a frame disposed so as to cover an outlet opening of the discharge passage; an obstacle member disposed in the frame such that discharge gas from the discharge passage collides against the obstacle member; and an auxiliary demister disposed on the upstream side of the obstacle member in the frame. A mesh-like demister is desirably disposed as the main demister so as to contain the whole of a cross section of the discharge chamber.

Other and further objects, features and advantages of the invention will be apparent from the following description taken in connection with the accompanying drawings wherein:

DETAILED DESCRIPTION OF THE PREFERRED EMBODIMENTS

Figure 1:
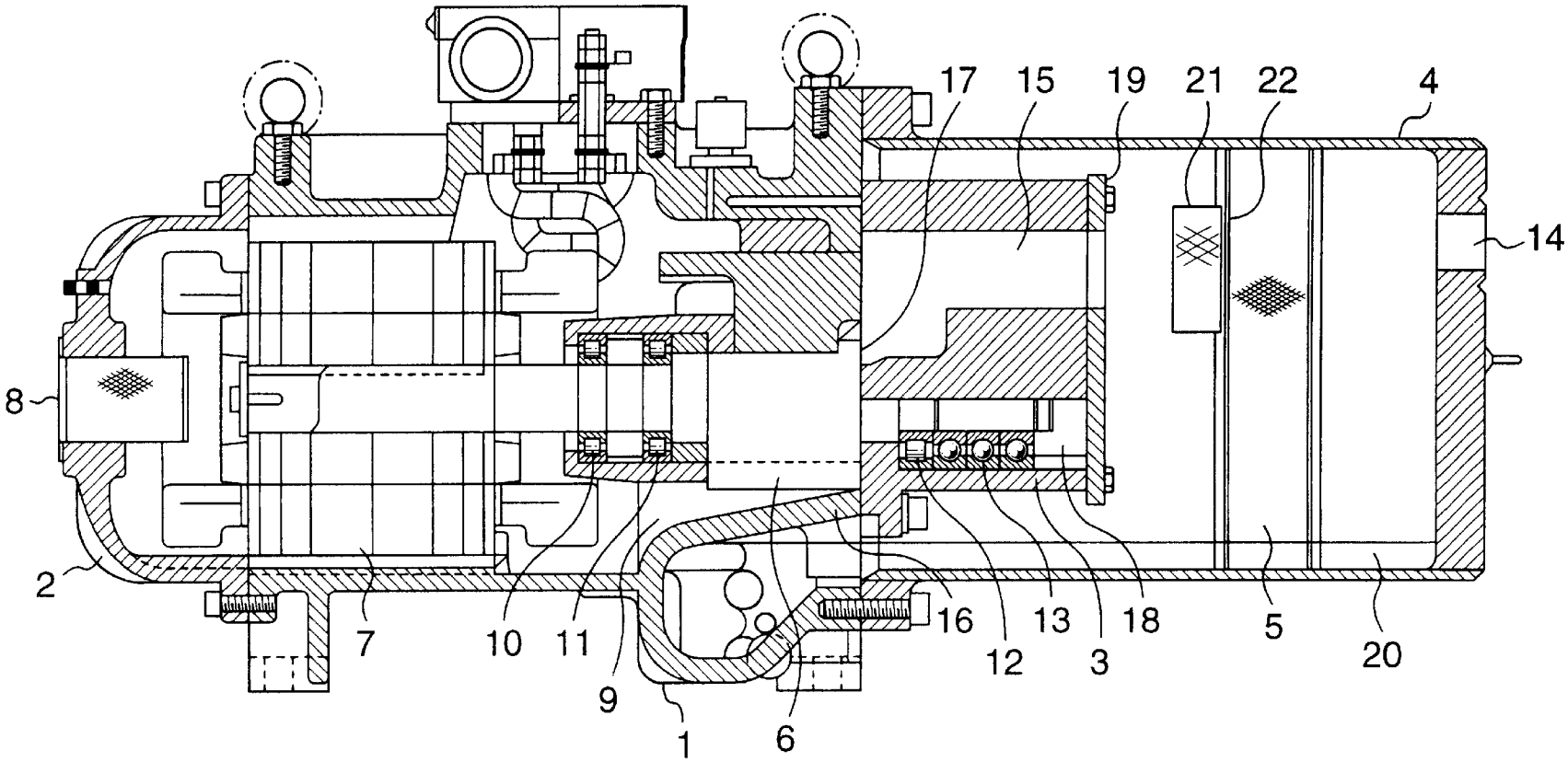
FIG. 1 is a sectional view of a screw compressor according to an embodiment of the present invention.
Figure 2:
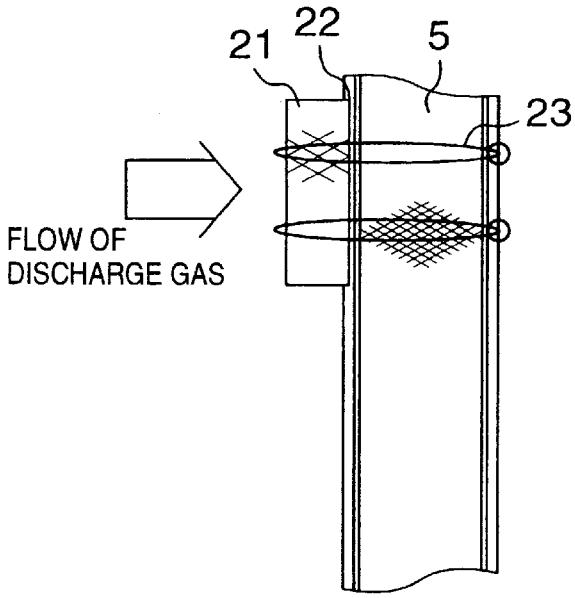
FIG. 2 is an enlarged sectional view of an auxiliary demister portion of the compressor of FIG. 1.

Hereinafter, an embodiment of the present invention will be described with reference to drawings. FIG. 1 shows the construction in cross section of a screw compressor according to the embodiment. FIG. 2 shows an example of auxiliary demister provided in a discharge chamber of the screw compressor of FIG. 1.

Referring to FIG. 1, the screw compressor comprises a casing 1, a motor cover 2 with an inlet 8 for suction, a discharge casing 3, and a discharge chamber 4 with an outlet 14 for discharge. The casing 1, motor cover 2 and discharge casing 3 and the wall of the discharge chamber 4 are hermetically joined with each other. The casing 1 receives an electric drive motor 7 therein and is provided with a cylindrical bore 16 and a suction port 9 for introducing gas into the bore 16.

The cylindrical bore 16 receives therein a male rotor 6 supported by roller bearings 10, 11 and 12 and ball bearings 13 so as to be rotatable, and a not-shown female rotor engaging with the male rotor 6. The male rotor 6 is directly joined to the electric drive motor 7.

The discharge casing 3 includes the roller bearing 12 and ball bearings 13. A cover plate 19 for closing a bearing chamber 18 containing the roller bearing 12 and ball bearings 13 is attached to one end of the discharge casing 3. The discharge casing 3 is fixed to the casing 1 by means of a bolt or the like.

In the discharge casing 3, a discharge passage 15 for gas is so formed as to communicate with the cylindrical bore 16 through a discharge port 17. An outlet of the passage 15 is opened in the discharge chamber 4.

Figure 3:
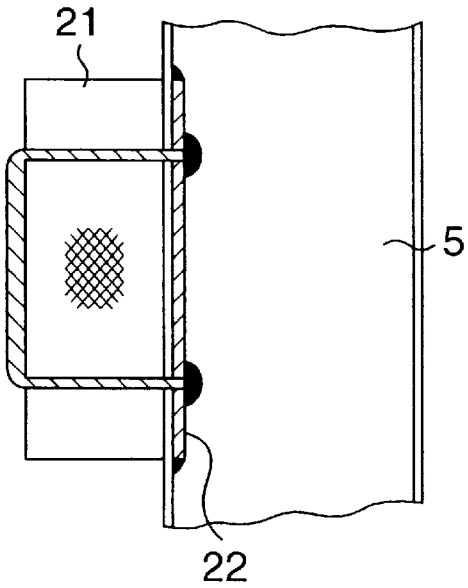
FIG. 3 is a detail view partly insection view of another example of auxiliary demister portion of the compressor of FIG. 1.
Figure 4:
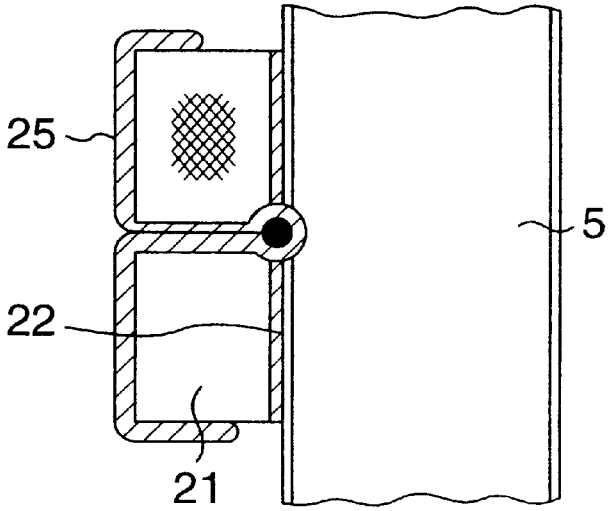
FIG. 4 is a detail view partly insection of another example of auxiliary demister portion of the compressor of FIG. 1.

A main demister 5 is provided in the discharge chamber 4. An auxiliary demister 21 and an obstacle plate 22 are attached to the main demister 5 by means of a tying wire 23. For attaching the auxiliary demister 21 and obstacle plate 22, welding shown in FIG. 3 for example or a fixing element 25 such as a split pin shown in FIG. 4 for example can be employed. For this purpose, any means may be employed if they are fixed at their specific positions.

The wall of the discharge chamber 4 is fixed to the casing 1 by means of a bolt or the like to surround the discharge casing 3. Lubricating oil is stored in the bottom of the discharge chamber 4. In the casing 1 and discharge casing 3, passages for feeding oil are formed such that the lower portion of the discharge chamber 4 communicates with each bearing.

Next, flows of coolant gas and oil will be described. Coolant gas at a low temperature and a low pressure sucked through the suction inlet 8 provided in the motor cover 2, passes through a gas passage formed between the electric drive motor 7 and casing 1, and air gaps between the stator and rotor of the motor 7 to cool the motor 7. The gas is then sucked into compression chambers formed by engaging surfaces of the male and female screw rotors and the casing 1.

With rotation of the male rotor 6 directly joined to the electric drive motor 7, the coolant gas is confined in each compression chamber and compressed gradually by contraction of the compression chamber to be at a high temperature and a high pressure. The gas is then introduced into the discharge passage 15 through the discharge port 17 provided in the discharge casing 3 to be discharged in the discharge chamber 4.

In the compression reaction forces acting on the male and female screw rotors at the time of compression, the radial load is borne by the roller bearings 10, 11 and 12 and the thrust load is borne by the ball bearings 13. Oil for lubricating and cooling those bearings is fed from an oil reservoir provided in a high-pressure portion in the casing 1 and passes through the oil passages communicating with the respective bearings. This feeding of oil is done due to differential pressure. The oil is then discharged in the discharge chamber 4 with compressed gas.

In the discharge chamber 4, the oil contained in the compressed gas passes through the auxiliary demister 21 attached to the main demister 5, and then collides against the obstacle plate 22. The first separation of oil is thereby performed. The auxiliary demister 21 has functions of collecting a part of oil while the discharge gas passes through it, and preventing oil from scattering when the oil collides against the obstacle plate 22 and is separated from the gas.

The flow of the discharge gas is made even in the discharge chamber 4 by passing through the auxiliary demister 21 and colliding against the obstacle plate 22. The gas then passes through the main demister 5 to separate the remaining oil from the gas. Separated oil is again stored in the oil reservoir in the lower portion of the casing 1. After the separation of oil, the compressed coolant gas is discharged from the compressor through the discharge outlet 14.

Even in case of an obstacle plate 22 made of a flat plate or a punching metal, a similar effect of separation by collision can be obtained. The shape of each of the auxiliary demister 21 and obstacle plate 22 may be a circle, a rectangle or any other shape.

Figure 5:
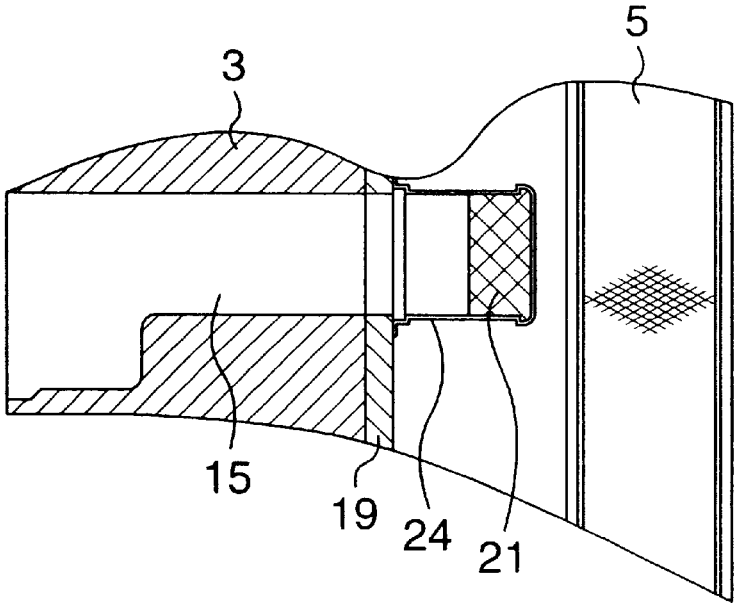
FIG. 5 is a detail view partly in section of a modification of the auxiliary demister portion of the compressor of FIG. 1.

FIG. 5 shows another embodiment of the present invention whose basic construction is the same as that of the first embodiment described above. In this embodiment, a frame 24 is attached to the cover plate 19 by means of a bolt or the like such that the frame 24 covers the opening of the discharge passage 15 for the discharge chamber 4.

The bottom wall of the frame 24 is made of a flat plate or a punching metal to separate oil from discharge gas by collision. In the frame 24, the auxiliary demister 21 is disposed for collecting a part of oil while the discharge gas passes through it, and preventing oil from scattering at the time of collision.

According to the present invention, at least one auxiliary demister is disposed at a local position immediately behind or near the downstream side of an outlet of a discharge passage in a discharge casing, and desirably, at least one obstacle plate is disposed on the downstream side of the auxiliary demister. As a result, a screw compressor can be obtained with high efficiency of oil separation and so a small amount of oil entrained out of the compressor.

What is claimed is:

1. A screw compressor comprising a discharge casing provided with a discharge passage for gas compressed by male and female rotors engaging with each other;

a discharge chamber containing said discharge casing;

a main demister disposed in said discharge chamber;

a frame disposed so as to cover an outlet opening of said discharge passage;

an obstacle member disposed in said frame such that discharge gas from said discharge passage collides against said obstacle member; and an auxiliary demister disposed on the upstream side of said obstacle member in said frame.

2. A screw compressor according to claim 1, wherein a mesh-like demister is disposed as said main demister so as to contain the whole of a cross section of said discharge chamber.

* * * * *